United States Patent [19]

Greis et al.

[11] Patent Number: 4,471,191

[45] Date of Patent: Sep. 11, 1984

[54] DEVICE FOR HEATING FLUENT MATERIAL FLOWING PAST SHORT-CIRCUITED HEATING ELEMENTS WITHIN INDUCTION COILS

[75] Inventors: Ingemar Greis, Sturefors; Artur Östlund, Linköping, both of Sweden

[73] Assignee: Asea AB, Västerås, Sweden

[21] Appl. No.: 421,348

[22] Filed: Sep. 22, 1982

[30] Foreign Application Priority Data

Sep. 24, 1981 [SE] Sweden ..... 8105640

[51] Int. Cl.[3] ..... H05B 6/10

[52] U.S. Cl. ..... 219/10.51; 219/10.49 R; 219/10.65

[58] Field of Search ..... 219/10.51, 10.49 R, 219/10.65, 10.57, 10.75

[56] References Cited

U.S. PATENT DOCUMENTS

| | | | |
|---|---|---|---|
| 1,818,953 | 8/1931 | Holmes | 219/10.49 R |
| 1,981,632 | 11/1934 | Northrop | 219/10.51 |
| 2,171,080 | 8/1939 | Ely | 219/10.51 |
| 2,407,562 | 9/1946 | Lofgren | 219/10.51 |
| 2,644,881 | 7/1953 | Schörg | 219/10.51 |
| 3,696,223 | 10/1972 | Metcalf et al. | 219/10.51 X |
| 3,821,508 | 6/1974 | Hagerty | 219/10.51 X |

FOREIGN PATENT DOCUMENTS

| | | | |
|---|---|---|---|
| 972114 | 7/1949 | Fed. Rep. of Germany . | |
| 2745135 | 12/1979 | Fed. Rep. of Germany . | |
| 787125 | 12/1957 | United Kingdom | 219/10.51 |

*Primary Examiner*—Roy N. Envall, Jr.
*Assistant Examiner*—Philip H. Leung
*Attorney, Agent, or Firm*—Watson, Cole, Grindle & Watson

[57] ABSTRACT

A device for heating a fluent material (e.g., gaseous or liquid media, such as air, water, etc.) comprises one or more electrical induction coils arranged around one or more central conduits for the medium to be heated, inside which coils there are arranged rings or spirals of metals which form one or more electrically-closed circuits, possibly after addition of short-circuit parts, which circuits, and possible metallic partition walls at these, are arranged to be inductively heated when the induction coils are electrically energized, heat generated in the heating elements passing to the fluent material flowing through the passageways.

8 Claims, 7 Drawing Figures

DEVICE FOR HEATING FLUENT MATERIAL FLOWING PAST SHORT-CIRCUITED HEATING ELEMENTS WITHIN INDUCTION COILS

TECHNICAL FIELD

The present invention relates to a device for heating a fluent material (e.g., gaseous or liquid media, such as air or water) by means of one or more electrical induction coils which heat the fluent material through the intermediary of metallic heating elements which form one or more electrically-closed circuits that become heated when the induction coils are supplied with current and then transfer heat to the fluent material made to flow past the elements.

It is notoriously well known to heat a metallic material by means of an induction coil and the inductive field of force such a coil produces. It is desired to extend this principle to the heating of fluent material, for example, for preheating air used in heating metallic scrap. One problem in this connection is in obtaining good heat transmission to the fluent material that is to be heated, and another problem is obtaining a heater which is simple to use and easy to manufacture. Among other things, it is desirable to be able to heat the fluent material at a relatively large volumetric flow and preferably also at a low pressure.

One object of the present invention is to provide a solution to the above-mentioned problems and other problems associated therewith.

BRIEF STATEMENT OF INVENTION

According to the invention there is provided a device for heating a fluent material comprising; an induction coil means, an inlet duct for conveying fluent material to be heated to the device, an outer material flow passage disposed within the coil means and having an inlet communicating with the inlet duct and an outlet, an inner material flow passage disposed within the outer passage having an inlet connected to the outlet of the outer passage and an outlet through which heated fluent material can leave the inner passage, and at least one annular metallic heating element disposed in at least one of the passages, each heating element being adapted to be inductively heated when the coil means in energized and to transfer heat to the fluent material flowing through the associated passage.

By means of the invention, a simple and efficient heater is obtained which is not particularly space-demanding and which can be expected to find a number of atrractive fields of application. An inductive heating device according to the invention is specially suitable for heating air or other fluids of relatively low pressure and large volumetric flows, and can also be used with other gases, such as water vapor, CO or $N_2$.

Where a metallic cylinder is used to separate the inner and outer passages, this cylinder can be employed to contribute to the transmission of thermal energy to the fluent material by electrical currents being induced in the cylinder (relatively high current, low voltage drops).

When the induction coils are energized, electrical currents are induced in the annular heating elements, which currents generate heat in the electrical circuits formed by the heating elements and possibly also in the passage-separating metallic cylinders, and in this way the passing fluent material, for example, air, becomes efficiently heated. The inner and outer passages are suitably mutual concentric passages. Means can be provided to induce turbulence in the flowing fluent material and/or to extend the surface area of the heating element(s) to enhance thermal transfer to the flowing medium.

BRIEF DESCRIPTION OF THE DRAWING

The invention will be exemplified in greater detail with reference to the accompanying drawing, in which.

DESCRIPTION OF PREFERRED EMBODIMENTS

Figure 3:
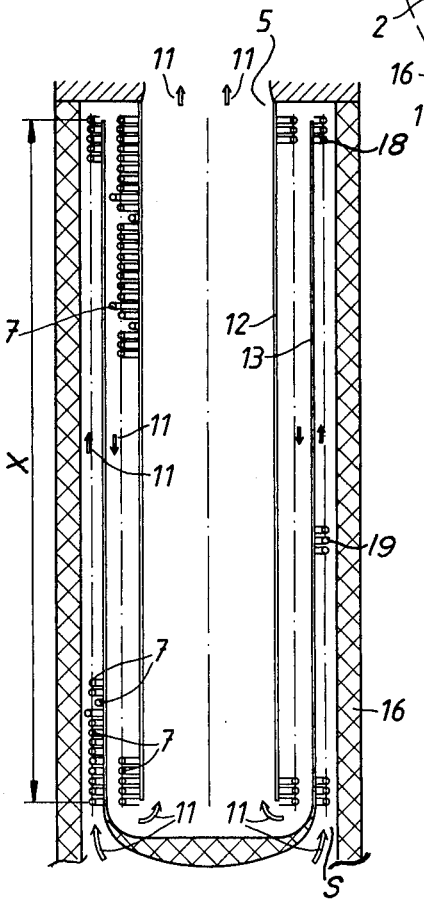
FIG. 3 shows the fluent material heating device of FIG. 2 in side sectional elevation.

The fluent material to be heated (for example, air at low temperature) enters a supply conduit 1 and is passed into a gas-tight outer casing 16 (see FIG. 1) which is located within a treatment space S within one or more induction coils 2, the induction coils being supplied with alternating current at mains frequency (or at some other suitable frequency). The casing 16 is shown as defining a labyrinth passage with two or more mutually concentrically-arranged passages 3, 4 for the fluent material. The fluent material passes from the supply duct 1 into the inlet end 3*a* of passage 3, along the passage 3, out the outlet end 3*b* of the passage 3, into the inlet end 4*a* of passage 4, along the passage 4, and out the outlet end 4*b* of passage 4 into the discharge channel 5. During this journey the fluent material is heated to a high temperature. Such a labyrinth passage is desirable, but not essential, the preferred passage shape being chosen with regard to the expected volumetric flow and pressure of the fluent material which, instead of air, could be, for example, water vapor, CO or $N_2$. As shown, the passages 3, 4 and discharge channel 5 are separated by metallic cylinders 6 (e.g., of sheet metal), which are suitably gas-tight. Metallic rings 7 or helices form heating elements and are arranged axially one after the other in the passages 3, 4. In the case illustrated, the heating elements 7 are concentric rings arranged axially one after the other, which rings are also arranged in a plurality of concentric layers, with at least one layer arranged in each passage 3, 4. FIG. 3 illustrates the disposition of the heating elements more clearly. The metallic cylinders 6 can be provided with flanges or other surface-enlarging means, which is also true of the heating elements 7.

Each individual ring 7 may define a separate heating element, or several rings together may define a heating element, by arranging it or them as an electrically-closed circuit, possibly by means of a shot-circuiting device (not shown). The heating elements 7 may also be arranged as one or more helix (helices), or spiral(s), also with short-curcuiting means (not shown). The heating elements 7 may be arranged concentrically around each other and/or axially one after another. The coil/coils 2 may be one or more in number. In the case of one coil, normally a single-phase electrical power supply is used, and this can also be the case when several coils are used. In the case of a plurality of coils, these can be supplied with multi-phase current—e.g., with one phase per coil—and the coils can be arranged axially after each other around the medium passageway or at the side of each other, for example, in the case of several heating devices where one single-phase coil is used for each phase of the supply.

When the induction coil or coils 2 is/are supplied with current, currents are induced in each heating element 7 which defines an electrically-closed circuit. Heat is generated in the elements 7 by the induced currents and the heat output is controlled by the selection of the electrical resistance of each element 7. The use of short-circuit elements may be necessary in order to ensure each element 7 is an electrically-closed circuit. The metallic cylinders 6 are also inductively heated and thus also contribute to the generated heating power. During this heating it is a question of low voltage drops and relatively high currents in heating elements 7 and cylinders 6.

The outer wall of the casing 16 is suitably made of a non-electrically conducting material, such as a ceramic material, a plastic material or glass, which is suitably gas-tight. Austenitic sheet metal can be used for fabricating the casing 16 and/or the cylinders 6. Each cylinder 6 may either be short-circuited or not, for example, by making the cylinder with a combination of a sheet metal and a ceramic material.

During the heating operation, the fluent material will contact the heating elements 7, which may be made from tubes, rods, or sheet metal bands, and which can be welded together into rings, helices or spirals. The material in the casing 16 and in the cylinders 6 should be suitably temperature-resistant and may possibly be non-ferromagnetic. By varying the amount of material in the heating elements 7, the inductive power may be varied from element to element. In this way an optimum heat transmission can be obtained having regard to the limitations of the material(s) used for the elements 7. The heating elements 7 may possibly be provided with turbulence-promoting members (which will be described in more detail with reference to FIG. 3) which will enhance the heat transfer to the fluent material.

Figure 1:
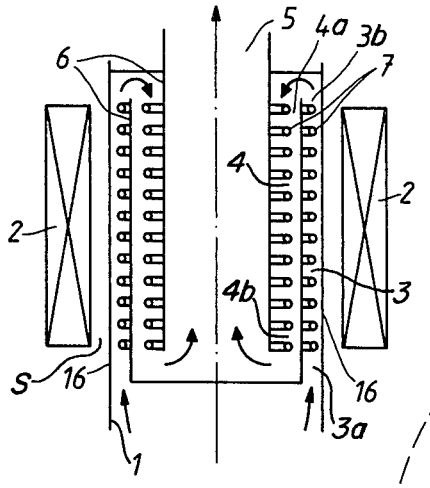
FIG. 1 shows, purely schematically, a fluent material heating device according to the invention.

One suitable field of application for the embodiment of the invention shown in FIG. 1 may be as an air preheater in a scrap heating plant and/or for recovering useful energy when undertaking power factor corrections.

Figure 2:
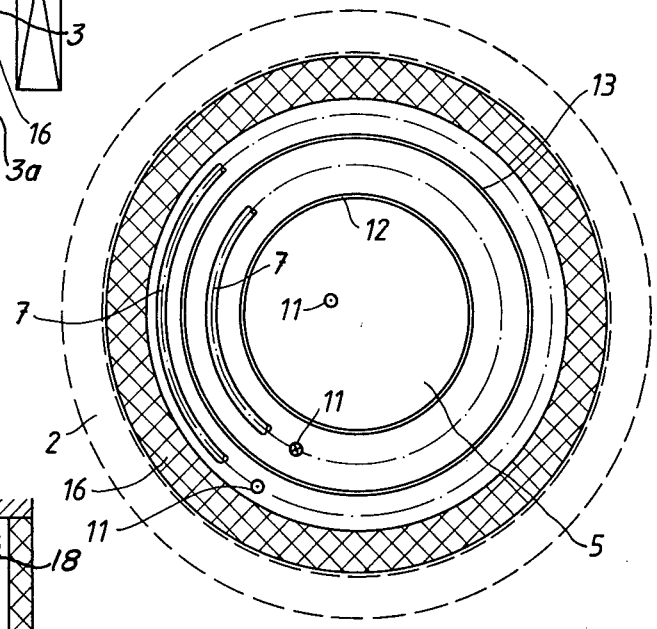
FIG. 2 shows a fluent material heating device according to the scheme of FIG. 1 as seen from above.

FIGS. 2 and 3 show a practical realization of the heater schematically shown in FIG. 1. Sheet metal cylinders 12, 13, as well as the outer casing 16, are arranged so as to form a labyrinth passage according to FIG. 1. The heating elements 7 are in the form of rings or spirals and are heated inductively by the coils 2 and thus heat up the passing air, which flows according to the arrows 11. Also the outer casing 16, which may be provided with flanges or other surface-enlarging elements (not shown), is suitably made of ceramic material.

The heat transmission to air from a heated body is dependent on the product of the heat transmission number $\alpha$, the heat-transmitting surface area A of the body and the temperature difference $\Delta t$ between the body and the air. The heat transmission is thus proportional to $A \cdot \alpha \cdot \Delta t$.

Figure 4:
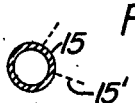
FIG. 4 shows a cross section through one type of heating element disposed in one of the two passages in the fluent material heating device of FIG. 3, FIGS. 5 and 6 schematically depict two alternative types and placements of heating elements which can be used within one of the two passages in the fluent material heating device of FIG. 3.
Figure 7:
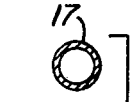
FIG. 7 shows comparative cross sections through two types of heating elements which can be currently disposed within one of the two passages in the fluent materal heating device of FIG. 3.
Figure 5:
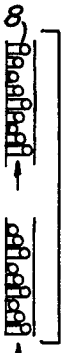
Figure 6:
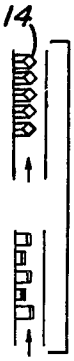

With a heater as described, a high $\alpha$ is obtained even at relatively moderate pressure drops. $\alpha$ can be further increased by increasing the turbulence in the air, for example, by varying the dimensions of some of the rings 7 relative to others so that the rings present an enhanced area A to the air current (see FIG. 3). In addition, it is a relatively simple matter to increase the area A by providing the heating elements with flanges (such as those shown dotted at 15' on the tube 15 in FIG. 4). Another great advantage is that $\Delta t$, which is limited by the maximum permissible temperature of the heating elements and the air temperature which increases through the heater, can be influenced individually for each heating element. As already mentioned, this can be done, for example, by varying the amount of metal in each heating element 7, which means that the induction power absorbed by each respective heating element can be varied. Therefore a maximum value of $\Delta t$ and thus maximum heat transmission can be obtained from each at each stage of the heating. FIG. 3 shows in more detail the passage of the air (represented by the arrows 11) and the arrangement of flow-separating sheet metal cylinders 12, 13, which are also heated inductively together with the heating elements 7. By different locations of the heating elements (see, e.g., elements 8 and 14 in FIGS. 5 and 6), the heat transmission can be improved; as mentioned, this can also be done by varying the amounts (thicknesses) of materials used to form the heating elements (see the thin-walled tube 17 and the thick-walled tube **17*a* FIG. 7 which represent the tubes found at points 18 and 19 in FIG. 3**). The turbulence can also be increased by displacing certain elements, for example every tenth ring, in addition to or as a substitute for other turbulence-increasing measures.

The passages through which the fluent material flows back and forth within the induction coils 2 need not pass exactly through the center of these coils; a certain lateral displacement can occur to make possible a suitable location of the heating elements.

Turbulence means can also be arranged individually, separate from the heating elements and the positional change of the different heating elements may also be arranged to take place along the entire length of the heater, or just at certain parts thereof.

In one practical case, an air preheater according to FIGS. 2 and 3 had a length (shown as X in FIG. 3) of 3600 mm.

The invention can be varied in many ways within the scope of the following claims.

What is claimed is:

1. A device for heating flowing fluent material, said device comprising:

at least one induction coil means which provide a treatment space therein, a supply duct for conveying flowing fluent material to be heated toward said treatment space, a first metallic cylinder forming a first passageway which extends within said treatment space, said first passageway having an inlet end and an outlet end, said inlet end being fed with flowing fluent material from said supply duct.

a second metallic cylinder forming a second passageway which extends within said treatment space, said second passageway being located radially inwardly of said first passageway, said second passageway having an inlet end and an outlet end, the inlet end of said second passageway being supplied with flowing fluent material from the outlet end of said first passageway, and at least one annular metalic, short-circuited heating element disposed in at least one of said first and second passageways adjacent one of said first and second metallic cylinders, each heating element being capable of becoming inductively heated when said induction coil means is energized, each heating element concurrently heating the associated metallic cylinder.

2. The device according to claim 1 wherein at least one annular heating element is disposed in each of said first and second passageways.

3. The device according to claim 1 wherein a plurality of annular heating elements are axially disposed, one after another, in each of said first and second passageways.

4. The device according to claim 3 wherein a non-electrically conducting cylindrical casing is located in the space within said induction coil means, wherein said first metallic cylinder is positioned radially within said cylindrical casing to thus form therebetween said first passageway, and wherein said supply duct communicates with one end of said cylindrical casing.

5. The device according to claim 3 wherein at least one of said plurality of annular heating elements in each of said first and second passageways include turbulence members for increasing the turbulence in the flowing fluent material passing thereby.

6. The device according to claim 3 wherein at least two of the plurality of heating elements in at least one of said first and second passageways are constructed with different thicknesses or metallic material so as to optimize the heating effect caused thereby on the flowing fluent material passing thereby.

7. The device according to claim 1 wherein one of said at least one annular metallic, short-circuited heating element is constructed to include surface-enlarging means.

8. The device according to claim 7 wherein said surface-enlarging means comprises multiple fins.

* * * * *